United States Patent [19]

Rosén

[11] Patent Number: 5,003,651

[45] **Date of Patent: * Apr. 2, 1991**

[54] CRIB WITH VIBRATION ATTENUATING MEANS

[76] Inventor: Karl G. Rosén, Karantänsgatan 13, S 442 35 Kungälv, Sweden

[ * ] Notice: The portion of the term of this patent subsequent to Jan. 16, 2007 has been disclaimed.

[21] Appl. No.: 415,599

[22] Filed: Oct. 2, 1989

Related U.S. Application Data

[63] Continuation of Ser. No. 162,693, Mar. 1, 1988, Pat. No. 4,893,366, which is a continuation-in-part of Ser. No. 889,933, filed as PCT SE85/0050 on Dec. 4, 1985, published as WO86/03388 on Jan. 19, 1986, abandoned.

[30] Foreign Application Priority Data

Dec. 10, 1984 [SE] Sweden ..... 8406250

[51] Int. Cl.[5] ..... A47D 9/02

[52] U.S. Cl. ..... 5/109; 5/508

[58] Field of Search ..... 5/108, 109, 101, 102, 5/93 R, 508; 128/33; 600/28; 248/638

[56] References Cited

U.S. PATENT DOCUMENTS

| | | | |
|---|---|---|---|
| 2,664,575 | 1/1954 | Lee | 5/109 |
| 2,668,302 | 2/1954 | Dengrove | 5/109 X |
| 2,910,977 | 11/1959 | Jeter | 5/109 X |
| 2,916,745 | 12/1959 | Lesk | 5/109 |
| 3,031,686 | 5/1962 | Muzzey | 5/109 |
| 3,040,342 | 6/1962 | Broers | 5/109 |
| 3,261,033 | 7/1966 | Martin | 5/109 |
| 3,292,611 | 12/1966 | Belkin | 600/28 |
| 3,311,935 | 4/1967 | Petty | 5/109 |
| 3,451,072 | 6/1969 | Cogdell | 5/109 |
| 3,680,156 | 8/1972 | McKee et al. | 5/109 X |
| 3,840,924 | 10/1974 | Hamilton | 5/508 |
| 3,872,526 | 3/1975 | Betts | 5/109 X |
| 3,934,283 | 1/1976 | Raffel | 5/109 |
| 3,952,343 | 4/1976 | Wong | 5/109 |
| 3,955,222 | 5/1976 | Pater | 5/109 |
| 4,066,072 | 1/1978 | Cummins | 5/424 X |
| 4,146,885 | 3/1979 | Lawson, Jr. | 5/449 X |
| 4,328,598 | 5/1982 | Evanson | 5/109 X |
| 4,620,334 | 11/1986 | Robinson | 128/33 |
| 4,681,096 | 7/1987 | Cuervo | 128/33 |

FOREIGN PATENT DOCUMENTS

| | | | |
|---|---|---|---|
| 92784 | 2/1983 | European Pat. Off. | 5/109 |
| 2369813 | 7/1978 | France | 5/109 |
| 85/03209 | 8/1985 | World Int. Prop. O. | 5/109 |

*Primary Examiner*—Alexander Grosz

*Attorney, Agent, or Firm*—Cushman, Darby & Cushman

[57] ABSTRACT

A device for attachment to a crib comprises a housing and a motor having an eccentric weight mounted on a shaft driven by the motor so as to produce vibrations upon actuation of the motor. The frequency of the vibrations is within the range of 800–2000 vibrations per minute. The device has sound generating means including volume and frequency control means. The device includes vibration attenuating means for attachment to the lower ends and at least an upper end of the crib for attenuation of the vibrations that would be transmitted to the floor supporting the lower ends of the crib and the walls that could be contacting at least an upper end of the crib.

4 Claims, 1 Drawing Sheet

CRIB WITH VIBRATION ATTENUATING MEANS

This application is a continuation of application Ser. No. 07/162,693 filed Mar. 1, 1988, now U.S. Pat. No. 4,893,366, which is a CIP of Ser. No. 06/889,933, filed as PCT SE85/00501 on Dec. 4, 1985, published as WO86/03388 on Jan. 19, 1986, now abandoned.

BACKGROUND OF THE INVENTION

1. Technical Field

Cries from children can be tolerated by parents of the children. Neighbors however consider crying children a disturbance and the noise a health hazard. Inspections on site often indicate poor wall or floor insulation. The present invention attacks the source of noise and reduces considerably the risk of disturbance.

2. Background Art

The cradle has been in use since ancient times. Parents have found that a slow periodic movement has a pacifying effect on the child as a whole. The periodicity of these movements has normally been within the range of up to 50 cycles per minute. It has not been possible to achieve higher frequencies with cradles or hanging baskets.

For a general feeling of well-being, complete beds have been developed which have been made to vibrate through some form of imbalance. At motels, particularly in the U.S.A., there are various devices with coin meters but these devices also have a relatively low frequency. It has been observed that discomforting vibrations have been transmitted through the buildings.

Empirically it has been found that vibrations have a tension-releasing effect on the human body. Vibration massage has long been a method applied. The vibrations are attenuated by the body being treated, and are not transmitted to the surroundings. The same is found with the sexual vibrators which have found a considerable market of late. Even here the empirical result from ancient times has now appeared in a modern form.

Modern research, particularly on infants, indicates that the crying which can be observed during the years of infancy is caused by cramp in the intestines. Cramp leads to pain which in turn leads to the very typical crying of a child which may often have the character of an environmental inconvenience - albeit temporary. The present invention is therefore directed to diverting the cause of irritating noise from small children. Knowledge about cramp provides the solution where children should be subjected to types of vibrations which relieve the attacks of cramp. It has been found particularly suitable in this context that the frequency used for treatment should be in the region of 800–2000 vibrations per minute. The purely technical problem is subjecting the child's intestines to a pulsating mechanical load while at the same time preventing this pulsating movement from being transmitted to the surroundings as an environmental inconvenience of a type other than a child's crying.

DISCLOSURE OF THE INVENTION

The concept according to this invention means that the child's place of rest, which may be a bed or a perambulator, is subjected to vibrations from some form of vibrator. Since the child as such cannot be treated directly and the intention is to gain the greatest possible degree of efficiency without disturbing the environment, a small motor is used, despite this, vibrations still occur outside the area of rest. The result of the invention must be that these vibrations are attenuated. Thus the present invention includes the addition of attenuation with respect to the surroundings. In purely mechanical terms this means that the place of rest is placed on an attenuating base. In addition, the vibrator may be equipped with a noise generator or this may be separately provided to generate a gentle hum which may be steady or undulating and which may be varied in intensity. This has been found to further sooth the infant and contribute to inducing sleep in the child.

MODE FOR CARRYING OUT THE INVENTION

Figure 1:
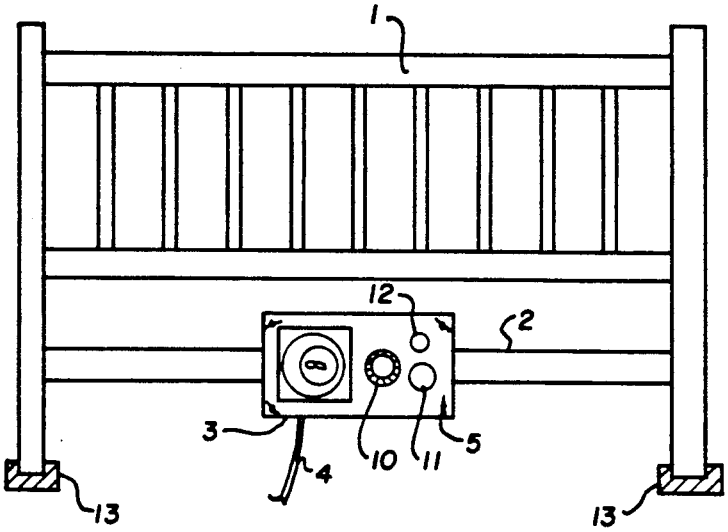
FIG. 1 is a side view in elevation showing the device of the present invention attached to a portion of a child's crib.
Figure 2:
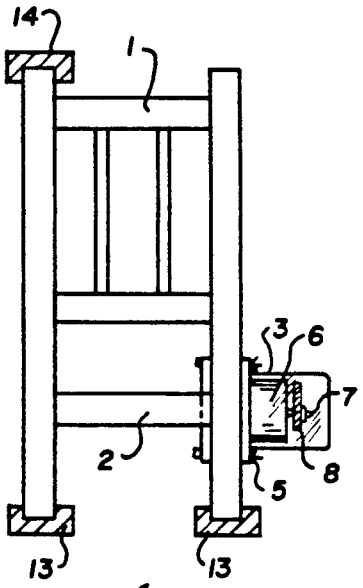
FIG. 2 is a side view in elevation of the crib of FIG. 1.

A suitable bed for a child below the age of six months was found. When the child had been given food and burped, a routine was developed so that the child would go to bed. A small motor was attached to the edge of the bed. The motor had an output of 7 watts and a rotational speed of 1400 revolutions per minute. A circular disc of plastic with an oval hole was fitted to the motor with one end of the oval hole at the center of the circular disc. The disc was attached to the threaded axle of the motor with a standard nut.

The attachment was made so that the disc's center was located to one side of the center of the axle. When the motor, which was connected to the mains, was started, the bed began to vibrate at the same frequency as the motor's speed. If this motor was started after the child had eaten, the child appeared to be quite happy and hardly any crying occurred. However if the motor was not started, a heart-rending noise was heard from the child approximately 30 minutes later which clearly indicated that the child did not feel well.

Previous attempts to reduce the noise from the child by carrying it around usually produced poor results. The family and the neighbors were regularly disturbed by a child's heart-rending cries after each meal. The parents found that the immediate neighbors often looked at them in a particular way as though the parents were obviously mistreating their child. However the use of the motor made the child quiet.

But the quietness of the child was at the cost of a new inconvenience. It was found that the natural frequency of the bed led to an amplification of the noise from the bed's vibrations. Even this noise had the character of an environmental inconvenience but the solving of this particular problem was simple.

The bed was placed on a soft base. Experiment showed that polyurethane foam plastic provided the best attenuation if each leg was placed in a special foot of urethane foam. However this was not always sufficient since sometimes the side of the bed came in contact with a wall and it was therefore found necessary to provide an attenuating layer or urethane foam between points where the bed could be expected to come in contact with adjacent walls and floor of the house.

By suitable standard adaptions of the motor's attachment it could be applied not only to the child's bed but also to the perambulator in which the child normally slept outside on a balcony. Even the perambulator exhibited the phenomenon of natural frequency and it was found necessary to reduce interference from the perambulator with polyurethane foam between the perambulator and its surroundings. Soft wheels also provided good attenuation.

In this particular successful test of invention's application it was found to be very useful to have the rotating plastic disc provided with an oval hole. Different underlays in the child's place of rest were found to have different degrees of attenuation. For the bed, in particular, a somewhat greater imbalance was needed than for the perambulator, when the child had eaten, to avoid disturbing cries.

Experiments with other motors indicated that a vibration frequency that was to low did not have an attenuating effect on the child's cries. It as not until a speed which exceeded 800 revs. per minute occurred in the imbalance that it began to have an attenuating effect on the environmental inconvenience caused by children's cries. At a frequency above 2000 revs. per minute it as found that the base at the child's place of rest attenuated the effect so that the vibrations did not reach the actual source of the noise, namely the child. At these higher frequencies children's cries occurred as though the invention were not being used.

Within the interval tested for vibration frequencies there is a range of frequencies which is very easy to transmit throughout a building. Even if the child's cry reaches the level of an environmental inconvenience it is inappropriate to remove one source of noise and then introduce another. Thus the reduction of interference at the child's place of rest is therefore a necessity and a significant part of the invention. The actual attenuating device's design is something that every person skilled in the art could produce. The amount of mass in movement is very small, child plus place of rest, and very soft material can be used. So far, polyurethane has been found to produce the best effect but this does not exclude the use of other attenuation devices since these fall within the framework of subsequent patent claims in a natural manner.

Where there has been no access to electrical power a simple mechanical spring-operated mechanism has provided good results for attenuating children's cries. It has been possible to wind the spring up to produce a given operating time depending on the tension of the spring. This has also been found to provide a very economic device.

Every person skilled in the art will easily understand that the imbalance does not necessarily need to be attached to the actual motor axle but can also be connected to some other driven axle. Such persons will also understand that the electrically-driven equipment can be provided with standard automatic devices for starting at given times and stopping after a certain period of use.

To further automate the device for attenuating children's cries, the actual device can be fitted with a microphone which at a certain noise level, from a child for example, starts the cry-attenuating device and starts the vibration of the child's place of rest. This type of equipment is well known to every person skilled in the art. However, the child's cries may not cease despite the use of automatic switching of the vibration device. This may have a natural explanation in the child being wet. In such cases, an additional alarm in the form of a visual or audible signal can be actuated after a certain amount of running time of the vibration device where the alarm, in such cases attracts the attention of the person caring for the child, for example at a hospital.

Figure 3:
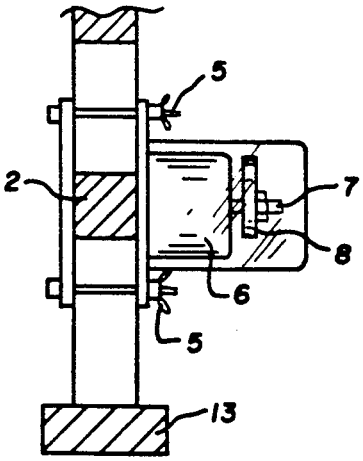
FIG. 3 is a detailed view partially in section of the device of FIG. 1.

As shown in the drawings, the device 3 is mounted on a lower portion 2 of a child's crib and includes a drive motor 6 and an eccentric weight in the form of a disc 8 mounted on a shaft 7 that is rotated by the motor 6. Current to the motor is controlled by an electrical device such as a variable resistance having a knob 10 which can be varied to control the amplitude of vibration as explained above. A noise generator 11 may also be provided and which may include a separate control for regulating the volume of the sound generated as well as its character, that is, either a steady hum or an undulating, gently rising and falling hum or similar soothing sound. The housing 3 can be mounted as shown in FIG. 3 by two parallel plates which are apertured to receive bolts 5 for tightening the plates about a suitable bar or leg 2 of the child's crib 1.

The attenuating bases 13 are provided to reduce transmission of the vibratory motion of the crib while the device 3 is in use.

INDUSTRIAL APPLICABILITY

The noise can cause an environmental inconvenience particularly in housing. This has a detrimental effect on the occupant's performance and thus has a disadvantageous effect on the national economy. Thus an environmental inconvenience is an evil. If this is caused by noise, there are two possible solutions. Either the noise is prevented from being transmitted within a building, which is unnecessarily expensive in many cases, or one can counteract the source of the noise.

The present invention illustrates a method and a device for combatting children's cries by introducing vibrations, which in themselves have an interfering effect on the child's place of rest. The invention means that even this interference is attenuated with urethane foam or similar device. Thus the invention means that interference with a number of different interference frequencies is counteracted with a frequency where the latter's transmission through a building is carefully attenuated in the vicinity of the source.

I claim:

1. Device for attachment to a crib comprising a housing and a motor having an eccentric weight mounted on a shaft driven by said motor so as to produce vibrations upon actuation of said motor, the frequency of said vibrations being within the range of 800–2000 vibrations per minute, said device having sound generating means, and wherein the device includes vibration attenuating means for attachment to the lower ends and at least an upper end of the crib for attenuation of the vibrations that would be transmitted to the floor supporting the lower ends of the crib and the walls that could be contacting at least an upper end of the crib.

2. The device as claimed in claim 1 wherein the motor is electrically driven.

3. The apparatus as claimed in claim 1 wherein said device includes sound detection means and motor control means responsive to said sound detection means for controlling actuation and deactuation of said motor in response to detection of sound.

4. A device of claim 1 wherein said sound generating device means includes volume and frequency control means.

* * * * *